United States Patent [19]

Kyle

[11] Patent Number: 4,657,337

[45] Date of Patent: Apr. 14, 1987

[54] ELECTRICAL CONNECTOR AND METHOD OF PRODUCING ELECTRICAL CONNECTOR

[76] Inventor: James C. Kyle, 2547 Fisher Rd., Roseburg, Oreg. 97470

[21] Appl. No.: 625,897

[22] Filed: Jun. 29, 1984

[51] Int. Cl.[4] ..... H01R 3/00

[52] U.S. Cl. ..... 339/278 C; 29/878; 174/152 GM; 339/DIG. 1

[58] Field of Search ..... 339/278 C, 278 T, DIG. 3, 339/DIG 1, 138; 174/152 GM; 29/876–878

[56] References Cited

U.S. PATENT DOCUMENTS

| | | | |
|---|---|---|---|
| 4,436,955 | 3/1984 | Kyle | 174/152 GM |
| 4,461,925 | 7/1984 | Bowsky et al. | 174/152 GM |
| 4,514,590 | 3/1985 | Kyle | 174/152 GM |

*Primary Examiner*—Gil Weidenfeld
*Assistant Examiner*—Paula A. Austin
*Attorney, Agent, or Firm*—Ellsworth R. Roston; Charles H. Schwartz

[57] ABSTRACT

A terminal pin extends through a first housing portion and has a flange. A hard bead having a high melting temperature is disposed on the flange. At least one layer of insulating material is disposed on the bead and is provided with a lower melting temperature than the bead. A second housing portion is attached to the first housing portion as by welding to define a housing. The layer of insulating material is melted and the terminal pin is pressed in a direction, while the layer is molten, to eliminate any air pockets in the layer and to provide for a hermetic sealing of the layer of insulating material to the bead, the terminal pin and the housing. Instead of a single layer of insulating material, at least a pair of insulating materials may be used. These layers may have melting temperatures less than the bead and the layer closest to the bead may have a higher melting temperature than the layer removed from the bead. The assembly of the connector may be accomplished by the rotation of a turntable. At each of a plurality of stations on the turntable, a different operation in assembling the connector may be provided. The operation performed at a number of the stations may be automated.

21 Claims, 4 Drawing Figures

FIG. 1
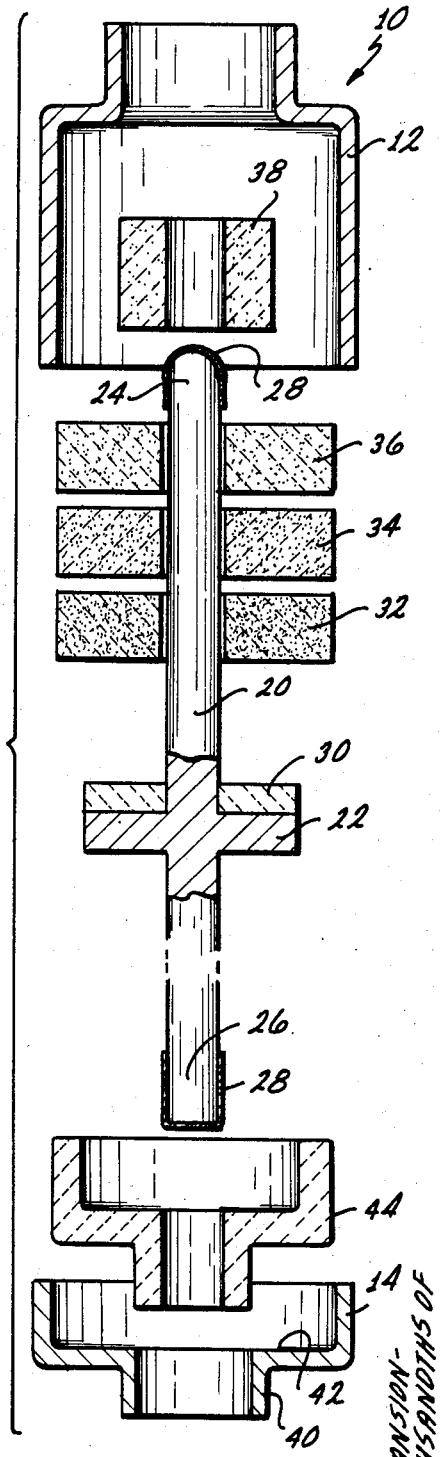
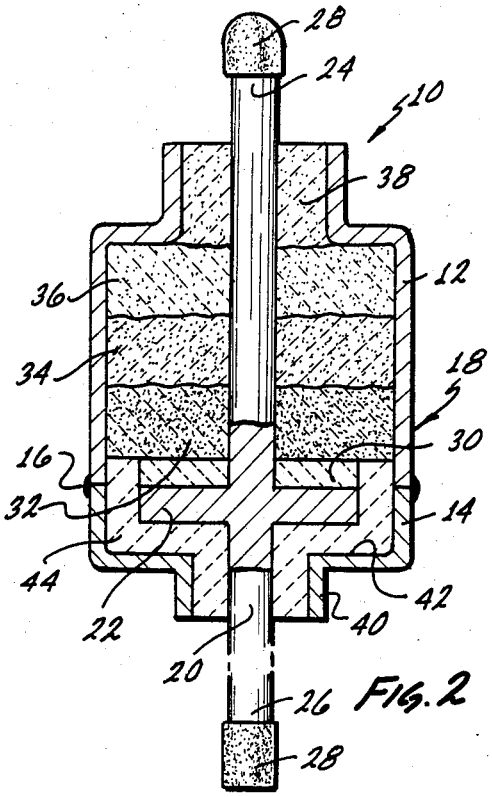
FIG. 2
FIG. 4
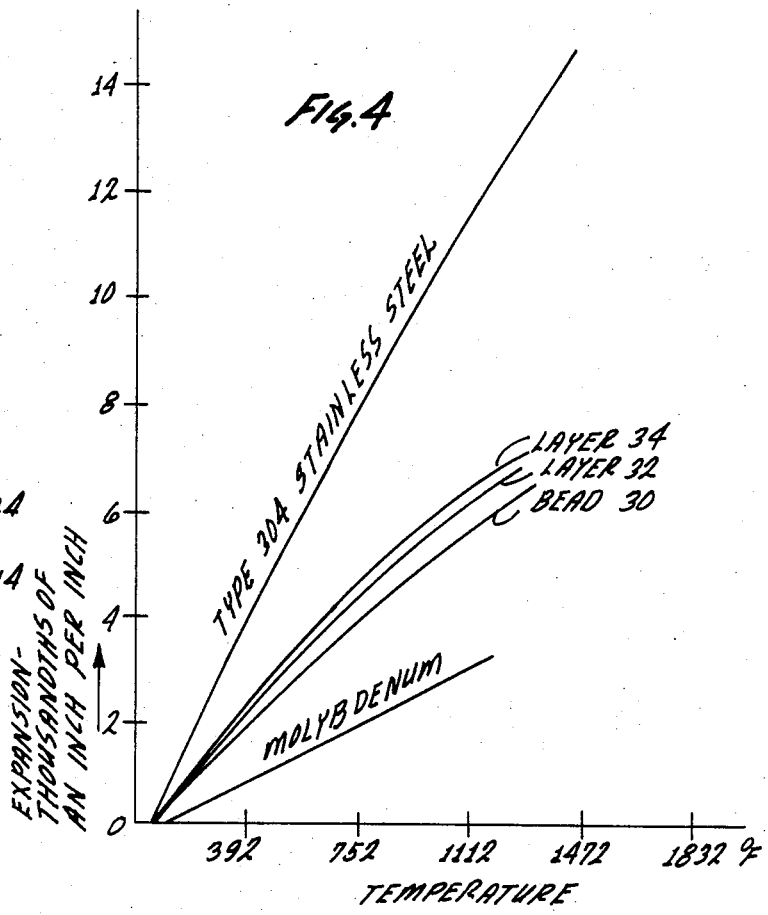

ELECTRICAL CONNECTOR AND METHOD OF PRODUCING ELECTRICAL CONNECTOR

This invention relates to electrical connectors and more particularly to electrical connectors which can be easily and reliably assembled. More particularly, the invention relates to methods of, and apparatus for, assembling such connectors.

Electrical connectors are an important element in electrical systems. They receive electrical signals from sources external to the electrical connectors and introduce such signals to other terminals in the electrical systems. Although electrical connectors are universally used in electrical systems, their assembly from individual components is still largely manual and their cost is still high in comparison to the cost of the electrical systems with which they interface.

A considerable effort has been made, and substantial cost have been incurred, to decrease the manual labor involved in assembling electrical connectors from their individual components, particularly in view of the large volume of connectors produced and the enormous dollar volume of their sales. In spite of such efforts, electrical connectors are still assembled primarily on a manual basis and their costs of manufacture are still quite high.

This invention provides an electrical connector which is manufactured on at least a semi-automated basis. The connector employs a minimal number of parts and is reliable in operation. The cost of manufacturing the connector is considerably reduced relative to the cost of manufacturing electrical connectors of comparable complexity in the prior art.

In one embodiment of the invention, a terminal pin extends through a first housing portion and has a flange. A hard bead having a high melting temperature is disposed on the flange. At least one layer of insulating material is disposed on the bead and is provided with a lower melting temperature than the bead. A second housing portion is attached to the first housing portion as by welding to define a housing.

The layer of insulating material is melted and the terminal pin is pressed in a direction, while the layer is molten, to eliminate any air pockets in the layer and to provide for a hermetic sealing of the layer of insulating material to the bead, the terminal pin and the housing. Instead of a single layer of insulating material, at least a pair of insulating materials may be used. These layers may have melting temperatures less than the bead and the layer closest to the bead may have a higher melting temperature than the layer removed from the bead.

The assembly of the connector may be accomplished by the rotation of a turntable. At each of a plurality of stations on the turntable, a different operation in assembling the connector may be provided. The operation performed at a number of the stations may be automated.

In the drawings:

FIG. 1 is an exploded perspective view of an electrical connector constituting one embodiment of the inventions;

FIG. 2 is a sectional view of the electrical connector of FIG. 1 in assembled form;

FIG. 4 shows curves of the coefficients of thermal expansion of different components in the electrical connector of FIGS. 1 and 2 with changes in temperature.

Figure 3:
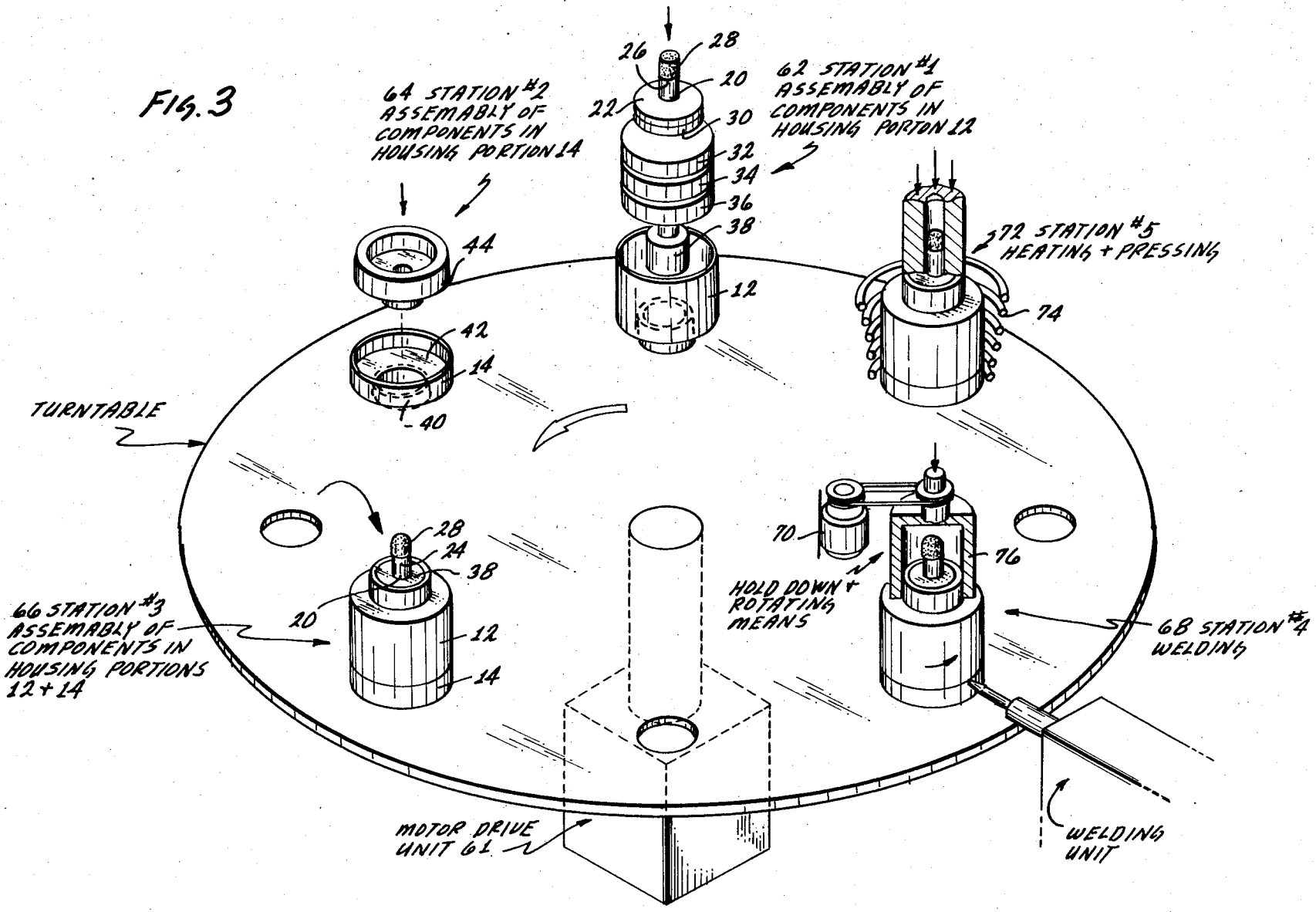
FIG. 3 is a schematic perspective view of a turntable for assembling the different components in the electrical assembly of FIGS. 1 and 2 on an at least a semi-automated basis.

In one embodiment of the invention, an electrical connector generally indicated at 10 is provided. The electrical connector 10 includes a pair of housing portions 12 and 14 suitably attached at 16 as by welding to define a housing generally indicated at 18. The housing portions 12 and 14 may be preferably made from a similar material such as steel, steel alloys, titanium, titanium alloys, aluminum or an alloy designated as "Inconel".

A terminal pin 20 having a flange 22 is preferably disposed in the housing portion 12 in spaced relationship to the housing portion. The terminal pin may be preferably made from a suitable material such as a noble metal, a material such as titanium coated with a noble metal, molybdenum or certain nickel alloys such as those designated by the trademarks "Rene 41" and "Inconel". The noble metal may be gold, silver or platinum.

Opposite ends 24 and 26 of the terminal pin 20 may be coated as at 28 with a suitable noble metal such as platinum, gold or silver to define electrical terminals for introducing signals to, and passing signals from, the connector 10.

The flange 22 on the terminal pin 20 is preferably disposed near the end of the housing portion 12 adjacent the housing portion 14. A bead 30 is disposed on the flange 22. The bead 30 is hard and has a high melting temperature. The bead 30 may be constructed as disclosed and claimed in application Ser. No. 284,129 filed by me on July 16, 1981, for a "Terminal Assembly".

At least one layer 32 of insulating material is disposed on the bead 30 in hermetically sealed relationship to the bead 30, the terminal pin 20 and the housing portion 12. The layer 32 of insulating material has a lower melting temperature than that of the bead 30. The layer 32 of insulating material may be constructed in a manner similar to that disclosed and claimed by me in application Ser. No. 284,129.

Preferably at least a pair of layers 32 and 34 of insulating material are disposed on the bead 30. The layers 32 and 34 have melting temperatures lower than the melting temperature of the bead 30. The layer 32 is adjacent the bead 30 and the layer 32 is removed from the bead. The layer 32 preferably has a higher melting temperature than the layer 34. The layers 32 and 34 may be constructed in a manner similar to that disclosed and claimed by me in application Ser. No. 284,129 filed by me on July 16, 1981, for a "Terminal Assembly". The layers 32 and 34 are preferably sealed to each other, the bead 30, the terminal pin 20 and the housing portion 12.

As will be appreciated, more than two (2) layers of insulating material may be used in place of the layers 32 and 34 of insulating material. Preferably, the layers in this plurality have decreased melting temperatures with progressive distances from the bead 30. For example, layers 32, 34 and 36 may be used.

The housing portion 14 preferably has a narrowed portion 40 at the end removed from the housing portion 12. The narrowed portion 40 defines an internal shoulder 42. An insulating member 44 is preferably disposed on the shoulder 42 to receive the flange 22 on the terminal pin 20. The insulating member 44 may be constructed in a manner similar to that disclosed and claimed in application Ser. No. 433,528 filed by me on Oct. 8, 1982, for an "Insulating Arrangement and Method of Providing Insulating". The insulating member 44 receives the flange 22 on the terminal pin 20 and insulates the terminal pin from the housing portion 14. Instead of a single member, the member 44 may be considered to represent a plurality of insulating members having progressive characteristics of melting temperature and/or hardness.

The terminal pin 20, bead 30 and the layers 32 and 34 of insulating material are initially assembled in the housing portion 12 and the insulating member 44 may be initially assembled in the housing portion 14.

The housing portions 12 and 14 are then preferably attached as by welding. The bead 30 and the layers 32 and 34 may be subsequently melted to produce a hermetic seal between the layers 32 and 34, the bead 30, the terminal pin 20 and the housing portion 12. While the bead 30 and the layers 32 and 34 are in their molten state, pressure may be applied to the terminal pin 20 in a direction to press the layers against the bead 30. This tends to eliminate any air pockets in the bead 30 and the layers 32, 34, 36 and 38. As will be appreciated, the bead 30 may be melted and fused to the terminal pin 20 and the housing portion 12 before the melting and fusion of the insulating layes 32 and 34. Alternatively, the bead 30 and the insulating layers 32, 34 and 36 may be melted simultaneously but pressure may not be applied against the layers 32, 34 and 36 until after the bead 30 has solidified or substantially solidified.

Instead of attaching as by welding the housing portions 12 and 14 before the formation of the hermetic seal between the insulating layers 32 and 34 and the terminal pin 20, the housing portion 12 and the bead 30, the housing portions 12 and 14 may be attached after the formation of the hermetic seals. This assures that any air in the layers 32 and 34 can escape when the layers are compressed even though the insulating layer 44 may have been previously sealed hermetically to the terminal pin 20 and the housing portion 14.

The electrical connector 10 described above has certain important advantages. One advantage is that the assembly of the connector 10 can be provided on a turntable 60 (FIG. 3) housing a plurality of stations. Furthermore, the assembly of the connector 10 is provided in a minimal number of steps, each of which can be operated automatically.

The electrical assembly 10 described above has other important advantages. It results from the fact that the housing portion 14 is not subjected to any heat during the melting of the bead 30 and the layers 32, 34 and 36 and the formation of the hermetic seals between the layers 32 and 34 and the bead 30, the terminal pin 20 and the housing portion 12. As a result, the housing portion 14 and the portion of the terminal pin 20 within the housing portion 14 are not subjected to oxidation during the heating of the components within the housing portion 12. This eliminates any need to treat the housing portion 14 or the portion of the terminal pin 20 within the housing portion 12, after the heating of the components within the housing portion 12, to eliminate any such effects of oxidation The turntable 60 may be provided for assembling the electrical connector 10. The turntable 60 may have a plurality of stations. The turntable may be rotated to the different stations as by a motor 61. At a first one 62 of the stations, the terminal pin 20 may be disposed within the housing portion 12 and the bead 30 may be disposed on the flange 22 of the terminal pin 20. The layers 32, 34 and 36 may then be disposed in that order on the bead 30.

At a second one 64 of the stations on the turntable, the insulating member (or members) 44 is disposed on the shoulder 42 in the housing portion 14. The elements on the housing portions 12 and 14 are then assembled in a third station 66 by disposing the terminal pin through the member 44 and the housing portion 14. The housing portions 12 and 14 may then be attached as by welding at a fourth station 68. A motor 70 may be provided for rotating the connector assembly so that the weld may be produced around the complete peripheries of the housing portions 32 and 34.

Heat is then applied to the bead 30 and the layers 32, 34 and 36 at the next station 72 as by a coil 74. As will be seen, the coil 74 preferably has a frusto-conical configuration so that it is repectively closer to the bead 30 and the layers 32 and 34 of insulating material than to the layers 32, 34 and 36. This causes the heat applied to the bead 30 and the layers 32 and 34 to be respectively greater than the heat applied to the layers 32, 34 and 36. Since the bead 30 and the layers 32 and 34 respectively have higher melting temperatures than the layers 32, 34 and 36, the heat applied to the bead 30 and the respective layers 32, 34 and 36 of insulating material is sufficient to melt such bead and such layers. The bead 30 and the layers 32, 34 and 36 may be respectively fused at temperatures of approximately 1800° F., 1600° F., 1200° F. and 1160° F.

While the bead 30 and the layers 32, 34 and 36 are still molten, a piston 76 is moved downwardly to press the layers 32, 34 and 36 against the bead 30 and the flange 22 on the terminal pin 20. This eliminates any voids or air pockets in the bead 30 and the layers 32, 34 and 36 of insulating material. It also insures that a hermetic seal is produced between the layers 32, 34 and 36, the bead 30, the terminal pin 20 and the housing portion 12. Although the pressure applied to the terminal pin 20 by the piston 76 is regulated to prevent the flange 22 on the terminal pin 20 from shearing, the flange is further protected against shearing by the inclusion of the bead 30. This results from the absorption by the bead 30 of the force applied by the piston 76 to the terminal pin 20.

The bead 30 is hard and is impervious to considerable forces such as a minimum of fifty (50) pounds tensile pull on the terminal pin 20. The bead 30 is also able to withstand a considerable range of temperatures without any degradation of the hermetic seal provided by the layer. The bead 30 is primarily polycrystalline and has nonviscous properties even when subjected to such elevated temperatures as temperatures to 1000° F.

The bead 30 is fused to the terminal pin 20 at an elevated temperature such as approximately 1800° F. The bead 30 provides an electrical resistance of at least 10,000 megohms when subjected to a direct potential as high as 500 volts even at the considerable pressures specified above and at elevated temperatures as high as approximately 1000° F.

The layer 32 is formed from an insulating material different from that constituting the bead 30. The layer 32 is fused to the bead 30, the layer 34, the terminal pin 20 and the housing portion 12. The layer 32 is primarily amorphous and is relatively viscous at elevated temperatures approaching 1000° F. The layer 32 is fused to the bead 30 and the layer 34 at an elevated temperature such as approximately 1600° F. The insulating material constituting the layer 32 has properties of maintaining a good hermetic seal with the housing portions 12 and 14, the terminal pin 20, the bead 30 and the layers 34 and 36 of insulating material even when subjected to an elevated temperature such as approximately 1000° F. for an extended period such as approximately 48 hours. The layer 32 has a suitable coefficient of thermal expansion such as a coefficient less than 5×10-6in/in/° C. The layer 32 has a higher coefficient of thermal expansion than the bead 30.

In the areas of fusion between the bead 30 and the layer 32, the fused material constitutes a mixture of the insulating material forming the bead 30 and the layer 32. This causes the mixture to have characteristics providing a composite of the characteristics of the insulating materials defining the bead 30 and the layer 32. Specifically, the fused material in the mixture is more crystalline than the layer 32 but less crystalline than the bead 30. Furthermore, the fused material in the mixture is able to withstand higher temperatures than the insulating material in the bead 30 without any degradation of the seals produced between the layers. The material is also able to withstand higher forces than the layer 32 without any degradation.

The layer 34 in turn fuses to the layer 32 and the housing portion 12 at a suitable temperature such as approximately 1200° F. The layer 36 in turn fuses to the layer 34 and the housing portion 12 at a suitable temperature such as approximately 1160° F. The layers 34 and 36 respectively have coefficients of thermal expansion higher than those of the layer 32 and the bead 30 and the layer 36 has a coefficient of thermal expansion less than that of the layer 34.

FIG. 4 illustrates the relationship between the coefficients of thermal expansion of the terminal pin 20 when made from molybdenum, the bead 30, the layers 32 and 34 and the housing portions 12 and 14 when made from aluminum. The coefficient of thermal expansion of the layer 36 is between those shown in FIG. 4 for the layer 34 and the terminal portions 12 and 14 when made from stainless steel of Type 300.

The relationship between the coefficients of thermal expansion of the layers 32, 34 and 36 and the melting temperatures of these layers offers certain advantages. For example, the melting temperatures increase with progressive layers toward the bead 30 and the coefficients of thermal expansion decrease in such progressive layers. This causes the layers with the relatively large coefficients of thermal expansion to melt first during the heating and to solidify last during the cooling. Furthermore, the melting occurs first in the layer 36 and then progresses toward the bead 30. The solidification during the cooling operation occurs progressively from the layer 32 adjacent the bead 30 toward the layer 36.

The progression from the periphery toward the bead 30 in the heating and from the bead 30 toward the axial periphery in the cooling operation offers certain advantages. This is particularly true since the coefficients of thermal expansion increase progressively from the bead 30 toward the axial periphery in the different layers. Since the axially external layers have increased coefficients of thermal expansion relative to the coefficients of thermal expansion of the axially internal layers, they are able to compensate more easily than the internal layers for any stresses in the terminal assembly as a result of changes in temperature. Furthermore, each successive layer toward the bead 30 provides a compensation of increased sensitivity because it has a decreased coefficient of thermal expansion in comparison to the coefficient of the layers external to it. This increased sensitivity for each layer can be particularly obtained because the bead 30 provides a thermal stability relative to the terminal pin 20. This results from the fact that the coefficient of thermal expansion of the bead 30 changes at a rate approaching the rate at which the coefficient of thermal expansion of the terminal pin 20 varies.

The insulating material for the layer 16 may be formed from the following materials in the following relative amounts by weight:

The insulating material for the layer 16 may be formed from the following materials in the following relative amounts by weight:

| Material | Relative Amount by Weight |
|---|---|
| Lead oxide (preferably red lead) | 41.0 |
| Zinc oxide | 3.6 |
| Alumina (preferably calcined) | 1.8 |
| Silicon dioxide | 27.0 |
| Cerium oxide | 0.9 |
| Lanthanum oxide | 2.7 |
| Cobalt oxide | 1.4 |
| Sodium antimonate | 7.2 |
| Zinc zirconium silicate | 2.7 |
| Bismuth trioxide | 9.0 |
| Molybdenum trioxide | 2.7 (but as low as 0.5% by weight) |

Oxides selected from a group consisting of the oxides of chromium, nickel and manganese may be substituted for the oxide of cobalt. Oxides selected from a group consisting of the oxides of lithium and potassium may be substituted for the oxide of cerium. A material such as zinc zirconium silicate may be substituted for the oxide of zinc. However, all of such substitutions may cause the properties of the resultant insulating material to deteriorate slightly from the properties of the material obtained from the mixture specified above.

The insulating material for the bead 30 may be produced by a novel method. The different materials are initially weighted and milled and dried in a dry ball mill for an extended period of time such as approximately three (3) hours. The materials may then be placed in a mullite crucible preheated to a suitable temperature such as approximately 2200° F. The mixture may be heated in the temperature of approximately 2200° F. for an extended period of time such as approximately six (6) hours. The mixture may thereafter be air cooled to a suitable temperature such as approximately 1000° F. The material may subsequently be heated in the mullite crucible to an elevated temperature such as approximately 2000° F. for an extended period such as approximately five (5) hours.

The smelted mixture may thereafter be fritted in deionized water and ground into particles in a suitable pulverizer which is non-contaminated. The particles may then be mixed with a suitable binder and may be pressed into beads which are then sintered at a suitable temperature such as approximately 1400° F. A suitable binder may be polyethylene glycol (marketed under the name "Carbowax") or an animal fat.

In the insulating material for the bead 30, the oxides of lead, silicon, bismuth and sodium constitute glass formers. The oxides of cerium, lanthanum, zinc and zirconium produce crystallites. These crystallites have different sizes and shapes to enhance the ability of the insulating material to withstand different operating conditions. The amount of crystallites in the material may be in the order of eighty-five percent (85%) to ninety percent (90%) and the remainder of the material may be amorphous. The amorphous portion may be dispersed somewhat uniformly throughout the insulating material.

The oxides of zinc and aluminum tend to increase the viscosity of the insulating material for the bead 30. The oxide of aluminum also increases the melting temperature of the insulating material. In addition to producing crystallites, the oxide of cerium prevents the oxide of lanthanum from crystallizing too quickly or from crystallizing irregularly. As a result, the oxide of cerium is instrumental in providing homogeneity in the insulating material. The oxide of cobalt and the oxide of molybdenum enhance the bond of the insulating material to certain elements such as nickel, vanadium and chromium when the terminal pin 20 and/or the housing portions 12 and 14 are made from a suitable material such as an "Inconel" alloy. The oxide of bismuth tends to promote high surface resistivity, thereby increasing the electrical resistance of the material. The oxide of bismuth also tends to prevent lead from leaching out of the material.

The insulating material for the insulating layer 32 may be produced as disclosed in U.S. Pat. No. 4,371,588 issued to me on Feb. 1, 1983, for an "Insulating Material and Method of Making Material". The insulating material for the layer 32 may have the following composition:

| Material | Range of Percentages by Weight |
|---|---|
| Lead oxide (red lead) | 57–68 |
| Silicon dioxide | 23–32 |
| Soda ash (sodium carbonate) | 0.4–0.6 |
| Titanium dioxide | 3.2–3.9 |
| Zirconium oxide | 3.0–3.7 |
| Boric acid | 2.2–2.6 |

As is well known, silicon dioxide is a common material in glasses and ceramics. Lead oxide provides a considerable control over the melting temperature of the insulating material for the layer 32 and also provides a considerable control over the characteristics of the coefficient of the thermal expansion of the insulating material. The lead oxide also controls the electrical resistivity of the insulating material for the layer 32. The relative percentages of the silicon dioxide and the lead oxide in the insulating material for the layer 32 tend to control the coefficient of thermal expansion of the material so that the changes in the coefficient of the thermal expansion of the material for the layer 32 approach those of the housing portions 12 and 14. The characteristics of the coefficient of thermal expansion of the material 32 is particularly enhanced because of the relatively high ratio of red lead to silicon dioxide in the insulating material for the layer 32.

Boric acid acts as a glass former. It facilitates the production of at least a partially amorphous state in the insulating material for the layer 32. Sodium carbonate is also a glass former. Since it is actually a powerful glass former, the relatively small amount of soda ash in the insulating material for the layer 32 has a greater effect than the low percentage would indicate. Soda ash is especially helpful in providing the insulating material for the layer 32 having the coefficient of thermal expansion of the layer 32 approach that of the housing portions 12 and 14, particularly when the member is made from a stainless steel of the 300 series. Zirconium oxide and titanium dioxide are crystallites and insure that the insulating material is at least partially crystalline.

The insulating material for the layer 32 may be formed by mixing the different materials in the particular ranges specified above and heating the mixture to a suitable temperature such as a temperature to approximately 1700° F. The mixture may then be maintained at this temperature for a suitable period of time such as a period to approximately three (3) hours. The material may then be quenched in a suitable liquid such as water and then ground and formed into beads.

The insulating material produced for the layer 32 after the quenching operation is primarily amorphous but partially polycrystalline. The relative proportions in the amorphous and polycrystalline states of the insulating materials for the layer 32 are somewhat independent of the temperatures and periods of time in which the mixture is heated. This is particularly true since the mixture tends to become partially amorphous and partially polycrystalline at the time that the mixture melts. As a result, the mixture may be melted repetitively without affecting simultaneously the properties of the material.

The insulating material for the layer 32 has certain important and desirable properties. It is provided with a high electrical resistance such as a resistance in the order of $10^{14}$ to $10^{15}$ ohms. Its coefficient of thermal expansion also changes at progressive temperatures throughout an extended range (such as a range to approximately 1000° F.) at a rate approaching the changes in the coefficient of thermal expansion of the housing portions 12 and 14 throughout such range. This is particularly true when the housing portions 12 and 14 are stainless steel in the 300 series.

As will be seen, the changes in the coefficients of thermal expansion of the housing portions 12 and 14 and the material for the layer 32 are approximated throughout a range of temperatures to approximately 1000° F. As a result, the material for the layer 32 is able to maintain the hermetic seal with the housing portions 12 and 14 throughout the extended range of temperatures to approximately 1000° F.

As will be appreciated, the compressive force exerted on the housing portions 12 and 14 by the material for the layer 32 is dependent upon the difference in the coefficients of thermal expansion of such material and the housing portions. Since the the coefficient of thermal expansion of the layer 32 approaches that of the housing portions 12 and 14 with changes in temperature, the compressive forces exerted on the housing portions 12 and 14 by the material for the layer 32 remain approximately constant with such changes in temperature. This facilitates the retention of the hermetic seal between the materials for the layers 32, 34 and 36, the bead 30, the terminal pin 20 and the housing portions 12 and 14 with such changes in temperature.

The percentage of the different oxides in the insulating material for the layer 32 may be as follows to provide for an efficient sealing of the material to the housing portions 12 and 14 when the housing portions are made from stainless steel in the 300 series:

| Material | Percentage by Weight |
|---|---|
| Lead oxide (red lead) | 64.9 |
| Silicon dioxide | 25.4 |
| Soda ash (sodium carbonate) | 0.5 |
| Titanium dioxide | 3.5 |
| Zirconium oxide | 3.3 |
| Boric acid | 2.4 |

The construction and method, of forming the layers 34 and 36 are fully disclosed in U.S. Pat. No. 4,352,951, issued to me on Oct. 5, 1982, for a "Ceramic Seal and Method of Producing Such Seal". The layers 34 and 36 of this invention include a pair of fluxes having different melting temperatures. Preferably one of the fluxes has a melting temperature greater by several hundreds of degrees Fahrenheit, such as approximately 200° F. to 300° F. than the other flux. By way of illustration, one of the fluxes (Flux A) may have a melting temperature of approximately 800° F. and a composition as follows:

| Material | Relative Percentage by Weight |
|---|---|
| Lead oxide (PbO) | 68.5 |
| Boric oxide ($B_2O_3$) | 10.5 |
| Silicon dioxide ($SiO_2$) | 21.0 |

The other flux (Flux B) may have a melting temperature of approximately 1000° F. and a composition as follows:

| Material | Relative Percentage by Weight |
|---|---|
| Lead oxide (PbO) | 80.0 |
| Boric oxide ($B_2O_3$) | 20.0 |

Fluxes A and B tend to constitute eutectics which effectively lower the melting point of the boric oxide in the fluxes.

When fluxes A and B are provided as specified above, flux A may have a relative percentage by weight in the material of approximately fifteen percent (15%) to twenty-five percent (25%) and flux B may have a relative percentage by weight in the material of approximately forty percent (40%) to fifty-five percent (55%). A stuffing material having properties of becoming crystalline is also provided in the material in a percentage by weight of approximately twenty percent (20%) to forty-five percent (45%).

The crystalline stuffing for the layers 20 and 22 includes oxides of zinc and zirconium and silicon dioxide to provide for the formation of crystals in at least a portion of the material. The oxides of zinc and zirconium and the silicon dioxide may be included in such forms as zinc zirconium silicate, zirconium spinel and zirconium silicate. For example, the crystal stuffing may be formed from the following materials in the following percentages by weight:

| Material | Relative Parts by Weight |
|---|---|
| Lead antimonate ($Pb_3(SbO_4)_2$) composed of lead, antimony and oxygen | 2 |
| Zinc zirconium silicate | 1 |
| Zirconium spinel | 1 |
| Zirconium silicate | 1 |

To form the material for the layers 34 and 36 of this invention and to produce hermetic seals with such material, fluxes A and B are first smelted separately and quenched in water to frit the material. For example, flux A may be smelted for a period of approximately two (2) hours at a temperature of approximately 1500° F. and then quenched in water, and flux B may be smelted for a period of approximately one (1) hour at a temperature of approximately 1200° F. and then quenched in water. The crystalline stuffing is smelted for a period of approximately three (3) hours at a temperature of approximately 1800° F. and is then quenched in water.

The fritted fluxes and the crystalline stuffing are then mixed in the desired percentages and ground such as in a ball mill for a period of approximately three (3) to four (4) hours. The material is then heated to a temperature of approximately 1200° F. for a period of approximately two (2) to three (3) hours. Preferably the material is stirred periodically such as every fifteen (15) minutes while it is being heated. The temperatures and times chosen for such heating operation are such as to partially combine the different compounds in the mixture. As a result, the material is predominantly amorphous but a portion has become crystalline. For example, approximately eighty percent (80%) of the material may be amorphous and approximately twenty percent (20%) may be crystalline. The material is then converted to a frit by quenching in water. The resultant material has a melting temperature of approximately 1100° F.

The material for the layers 34 and 36 is then heated to a temperature slightly above its melting temperature for a period of time dependent upon the characteristics desired for the material. For example, the material may be heated to a temperature of approximately 1200° F. (100° F. above the melting temperature) for a period of approximately three (3) to four (4) hours. The material slowly changes from an amorphous glass to a ceramic as it is being heated. (Furthermore, the coefficient of thermal expansion becomes progressively crystalline.)

The temperature and duration of the heating operation for the layers 34 and 36 are chosen so that the coefficient of thermal expansion of the material is slightly less than the coefficient of thermal expansion of the member, such as the ferrule 12 or the terminal pin 14, to be sealed. The temperature and duration of the heating operation are such that the material for the layers 34 and 36 is approximately fifty percent (50%) amorphous and approximately fifty percent (50%) crystalline or slightly more crystalline than amorphous.

The fritted material is then pulverized and separated into different sizes. Beads are then formed by mixing particles of different sizes with a suitable material such as polyethylene glycol (marketed under the name "Carbowax") or an animal fat and pressing the particles together. For example, approximately forty percent (40%) of particles by weight of 150 mesh and approximately fifty percent (50%) of particles of 300 mesh may be mixed with polyethylene glycol or an animal fat where the polyethylene glycol or the animal fat comprises one and one-half percent (1.5%) to three percent (3%) by weight in the mixture. The particles may then be pressed together to form the beads.

The beads are then disposed on the layer 32 of insulating material between the terminal pin 20 and the housing portion 12. The combination is then heated to a suitable temperature such as approximately 1225° F. for a suitable period of time such as a period to approximately thirty (30) minutes. The material then becomes fused to the terminal pin 20 and the housing portion 12. Since the combination is heated for only a relatively short period of time, the crystalline structure of the material for the layers 34 and 36 is not changed significantly during the heating operation.

The fusion of the layers 34 and 36 to the layer 32, the housing portion 12 and the terminal 20 is facilitated by cooling the material rapidly in air. This causes the material in the layer 36 to press against the housing portion 12 as it is rapidly cooled. By pressing against the housing portion 12 during such cooling, the material facilitates the production of a hermetic seal with the housing portion 12.

The hermetic seal between the layers 34 and 36 and the housing portion 12 and between the layers 34 and 36 and the terminal pin 20 are produced in various way. For example, a thin polycrystalline layer is produced in the layers 34 and 36 at the boundaries with the housing portion 12. For example, zinc silicate ($Zn_2SiO_4$) or a relatively complex compound of zinc, oxygen and silicon (2ZnO.SiO) having the same chemical composition as zinc silicate or a combination of both is formed at such boundary. These crystals tend to become formed in the presence of lead or antimony. These zinc compounds become crystallized in the form of Willemite crystals. Furthermore, crystals of zirconium silicate also become produced at such boundary.

The crystallization of the zirconium silicate occurs in the presence of lead. The crystallization of the zirconium silicate is facilitated by the inclusion of zinc zirconium silicate in the mixture since this compound tends to become dissolved at a lower temperature than zirconium silicate. Zinc zirconium silicate and zirconium silicate tend to exist as natural minerals and are preferably used in this form.

The Willemite crystals are of a different size and shape than the crystals of zirconium silicate. For example, the crystals of zirconium silicate tend to be smaller than the Willemite crystals. This causes nucleations of different sizes to be produced and facilitates the flexing and bending of the crystalline layer adjacent the ferrule when subjected to thermal and mechanical shocks. In this way, the hermetic seal is maintained even when the material is subjected to severe thermal or mechanical shocks.

Zirconium spinel tends to increase the mechanical strength of the material of the layers 34 and 36. When introduced into the material, zirconium spinel is already in crystalline form so that it does not change as the material of the layers 34 and 36 is heated and cooled as specified above. As a result, zirconium spinel acts as a filler in the material. Zirconium spinel tends to exist as a natural mineral and is preferably used in this form.

An oxygen valence bond is also produced between the layers 34 and 36 and the housing portion 12 to facilitate the formation of a hermetic seal between them. This oxygen valence bond results from a chemical bond between oxygen atoms in the material and atoms on the surface of the housing portion 12. In other words, the oxygen is shared by the layer on the surface of the housing portion 12 and the layers 34 and 36. This oxygen valence bond is produced during the heating of the material of the layers 34 and 36 and the housing portion 12 and the terminal pin 20 to the relatively high temperatures.

The material constituting the layers 34 and 36 also provides other advantages of some importance. For example, the material constituting the layers 34 and 36 provides a high dielectric constant considerably greater than that of most other materials now in use. By way of illustration, the electrical insulation provided by the layers 34 and 36 between the terminal pin 20 and the housing portion 12 is as high as 1018 ohms. This is important in such equipment as heart pacemakers which have to operate satisfactorily under all of the adverse sets of circumstances which a human body is capable of producing.

The material constituting the layers 34 and 36 also has other advantages of some importance. For example, when the operation of hermetically sealing the terminal pin 20 and the housing portion 12 has been completed, tests are made to determine if a hermetic seal has actually been produced. If a hermetic seal has not been produced, the combination of the terminal pin 20, the housing portion 12, the bead 30 and the layers 32, 34 and 36 may be fused at the temperature of approximately 1200° F. for an additional period to approximately thirty (30) minutes. Since the material constituting the layers 34 and 36 is still somewhat amorphous, this additional fusing operation tends to facilitate the creation of the oxygen valence bond between the material and the housing portion 12 and between the material and the terminal pin 20. It also tends to facilitate the creation of a polycrystalline structure in the material, particularly at the surface adjacent the housing portion 12. As a result, any failure to produce a hermetic seal tends to become corrected.

The layer 34 may be provided with the following composition:

| Material | Relative Amounts in Mixture |
|---|---|
| Zirconium silicate | 6.8 |
| Zinc zirconium silicate | 3.4 |
| Boric oxide | 14.0 |
| Zirconium spinel | 3.4 |
| Red lead | 61.3 |
| Bismuth trioxide | 6.8 |
| Quartz | 4.3 |
| Fusing temperature | 1200° F. |

The fusing temperature of the layer 34 is approximately 1200° F.

The layer 36 may be provided with the same composition as the layer 34 except that it does not include any silicon dioxide. The layer 36 may be formed by substantially the same method as that described above the layer 34. However, the layer 36 may have a melting temperature of approximately 1160° F.

After being stacked on the bead 30 between the housing portion 12 and the terminal pin 20 the beads of the materials for the layers 32, 34 and 36 and the bead 30, the housing portion 12 and the terminal pin 20 are heated to an elevated temperature for a limited period of time. For example, the heating may be provided for the bead 30 to a suitable temperature such as approximately 1800° F. for a limited period of time to produce the seal between the housing portion 12, the bead 30 and the terminal pin 20. The layers 32, 34 and 36 simultaneously receive reduced temperatures to melt such layers.

Although this application has been disclosed and illustrated with reference to particular applications, the principles involved are susceptible of numerous other applications which will be apparent to persons skilled in the art. The invention is, therefore, to be limited only as indicated by the scope of the appended claims.

I claim:

1. In combination in an electrical connector, first and second housings formed into a unitary assembly, a terminal pin extending through the housings in spaced relationship with the housings, a flange on the terminal pin at a position adjacent the second housing, a bead made from a hard insulating material and having a high melting temperature, the bead being disposed on the flange and pressed against the flange and providing insulation between the terminal pin and the housings, and at least one layer of insulating material disposed on the bead in pressed relationship with the bead and the flange on the terminal pin and the housings and having a reduced melting temperature relative to the bead and providing an electrical insulating relationship between the terminal pin and the housings, the layer of insulating material providing a hermetical seal with the bead, the terminal pin and the housings.

2. A combination as set forth in claim 1, including, the housings having a hollow annular shape and the terminal pin extending through the annular housings in spaced relationship to the housings.

3. A combination as set forth in claim 2 wherein at least a pair of insulating materials are disposed on the bead and are hermetically sealed to each other and to the bead, the terminal pin and the housing and are pressed against each other and the bead and wherein the bead is provided with a first melting temperature and the insulating material adjacent the bead is provided with a lower melting temperature than the first melting temperature and the insulating material further removed from the bead than the adjacent insulating material is provided with a lower melting temperature than the melting temperature of the adjacent insulating material.

4. A combination as set forth in claim 1 wherein the terminal pin has a first coefficient of thermal expansion and the housing has a second coefficient of thermal expansion, different from the first coefficient of thermal expansion and the bead has a coefficient of thermal expansion between the coefficients of thermal expansion of the terminal pin and the housing but approaching that of the terminal pin and the insulating material has a coefficient of thermal expansion between the coefficients of thermal expansion of the terminal pin and the housing but closer to that of the housing than the coefficient of thermal expansion of the bead.

5. A combination as set forth in claim 1 wherein the bead is primarily polycrystalline and the insulating material is primarily amorphous.

6. In combination in an electrical connector, a terminal pin, a housing disposed in spaced relationship to the terminal pin, the housing being made from first and second attached portions, a flange on the terminal pin within the housing, a bead on the flange within the housing, the bead being hard and having a high melting temperature and being pressed against the terminal pin, and at least one layer of insulating material disposed on the bead within the housing and in spaced relationship to the flange on the terminal pin, the at least one layer of insulating material having a lower melting temperature than that of the bead and being hermetically sealed to the bead, the terminal pin and the housing.

7. A combination as set forth in claim 6 wherein a plurality of layers of insulating material are disposed on the bead and within the housing and each of the layers has a melting temperature less than the melting temperature of the bead and the melting temperature of each of the layers is progressively less than the melting temperature of the adjacent layer with progressive distances from the bead.

8. A combination as recited in claim 6 wherein the coefficient of thermal expansion of the terminal pin is different from the coefficient of thermal expansion of the housing and the coefficients of thermal expansion of the insulating material and the bead are between those of the terminal pin and the housing.

9. A combination as set forth in claim 8 wherein the coefficient of thermal expansion of the bead is closer to the coefficient of thermal expansion of the terminal pin then the coefficient of thermal expansion of the insulating material.

10. A combination as set forth in claim 6 wherein the first and second portions of the housing are made from the same material and wherein at least a pair of insulating materials are disposed on the bead within the first portion of the housing and the pair of insulating materials have a lower melting temperature than that of the bead and are hermetically sealed to each other, the bead, the terminal pin and the housing and a first one of the insulating materials is closer to the bead than the other one of the insulating materials and has a higher melting temperature than the other one of the insulating materials.

11. A combination as set forth in claim 10 wherein the coefficient of thermal expansion of the layer of the insulating material further removed from the bead is greater than the coefficient of thermal expansion of the insulating material closer to the bead and wherein the bead has a lower coefficient of thermal expansion than the layers of insulating material and wherein the coefficients of thermal expansion of the insulating materials and of the bead are between the coefficients of thermal expansion of the terminal pin and the housing.

12. A combination as set forth in claim 11 wherein the coefficient of thermal expansion of the terminal pin is less than that of the bead and the coefficient of thermal expansion of the housing is greater than that of the insulating materials.

13. A method of forming an electrical connection, including the steps of:

providing first and second housing portions dimensioned to become attached into a unitary housing, providing a terminal pin having a flange, disposing on the flange a bead having hard properties and having a relatively high melting temperature which is less than the melting temperatures of the housing and the terminal pin, disposing at least a pair of layers of insulating material on the bead, the layers of insulating material having a lower melting temperature than the melting temperature of the bead and the layer of insulating material adjacent to the bead having a higher melting temperature than the melting temperature of the layer of insulating material removed from the bead, disposing the terminal pin, the bead and the insulating materials in the first housing portion, attaching the first and second housing portions, and melting the pair of layers of insulating material and the bead to hermetically seal the layers to each other, the terminal pin, the bead and the housing.

14. A method as set forth in claim 13, including the step of:

providing the second housing portion in a pre-finished state.

15. A method as set forth in claim 14, including the step of:

pressing the second housing portion against the flange on the terminal pin with the pair of layers of insulating material and the bead in the melted state to eliminate any air pockets in the layers.

16. A method as set forth in claim 13 wherein the terminal pin, the bead, the layer of insulating material adjacent the bead, the layer of insulating material removed from the bead and the housing have progressively increased coefficients of thermal expansion.

17. A method as set forth in claim 16 wherein the bead has a coefficient of thermal expansion closer to the coefficient of thermal expansion of the terminal pin than the coefficient of thermal expansion of the insulating material.

18. A method of forming an electrical connection, including the steps of:

providing first and second housing portions dimensioned to become attached into a unitary housing, providing a terminal pin having a flange, disposing on the flange a bead having hard properties and having a high melting temperature, disposing at least a pair of layers of insulating material on the bead, the layers of insulating material having a lower melting temperature than the bead and the layer of insulating material adjacent to the bead having a higher melting temperature than the layer of insulating material removed from the bead, attaching the first and second housing portions, and melting the at least the pair of layers of insulating material and the bead to hermetically seal the layers to each other, the terminal pin, the bead and the housing, pressing the terminal pin with the pair of layers of insulating material and the bead in the melted state to eliminate any air pockets in the layers.

19. A method as set forth in claim 18 wherein only the first housing portion and the portion of the terminal pin adjacent the first housing portion are subjected to heat during the melting of the pair of the insulating layers and the bead and wherein only the first housing portion and the portion of the terminal pin adjacent the first housing portion are treated after the melting of the pair of the insulating layers and the bead.

20. A method as set forth in claim 18 wherein the bead and the layers of insulating material respectively have coefficients of thermal expansion which are between the coefficients of thermal expansion of the terminal pin and the housing.

21. A method of forming an electrical connection, including the steps of:

providing first and second housing portions dimensioned to become attached into a unitary housing, providing a terminal pin having a flange, disposing on the flange a bead having hard properties and having a high melting temperature, disposing at least a pair of layers of insulating material on the bead, the layers of insulating material having a lower melting temperature than the bead and the layer of insulating material adjacent to the bead having a higher melting temperature than the layer of insulating material removed from the bead, attaching the first and second housing portions, and melting the at least the pair of layers of insulating material and the bead to hermetically seal the layers to each other, the terminal pin, the bead and the housing, wherein only the first housing portion and the portion of the terminal pin adjacent the first housing portion are subjected to oxidation during the melting of the pair of the insulating layers and the bead.

* * * * *